United States Patent [19]

Billings

[11] 4,062,330

[45] Dec. 13, 1977

[54] ROTARY ENGINE INTAKE AND EXHAUST SYSTEM

[75] Inventor: Roger Evan Billings, Provo, Utah

[73] Assignee: Billings Energy Corporation, Provo, Utah

[21] Appl. No.: 593,004

[22] Filed: July 3, 1975

[51] Int. Cl.[2] ..... F02B 57/06

[52] U.S. Cl. ..... 123/44 R; 123/44 D

[58] Field of Search ..... 123/44 R, 44 D

[56] References Cited

U.S. PATENT DOCUMENTS

| | | | |
|---|---|---|---|
| 709,877 | 9/1902 | Cullen | 123/44 R |
| 1,019,856 | 3/1912 | Strickland | 123/44 R |
| 1,220,455 | 3/1917 | Rasmusen et al. | 123/44 D |
| 1,276,381 | 8/1918 | Loftus | 123/44 R |
| 1,407,659 | 2/1922 | Kemp | 123/44 R |
| 1,623,296 | 4/1927 | Augustine | 123/44 R |
| 1,705,130 | 3/1929 | McKlusky | 123/44 R |
| 2,330,528 | 9/1943 | Stucke | 123/44 R |
| 2,683,422 | 7/1954 | Richards, Jr. | 123/44 R |
| 3,205,877 | 9/1965 | Rychlik | 123/44 D |
| 3,599,612 | 8/1971 | Villella | 123/44 D |
| 3,739,756 | 6/1973 | Villella | 123/44 D |
| 3,857,371 | 12/1974 | Gibson | 123/44 R |

FOREIGN PATENT DOCUMENTS

| | | | |
|---|---|---|---|
| 935,520 | 6/1948 | France | 123/44 R |
| 106,803 | 4/1918 | Germany | 123/44 R |
| 20,813 | 5/1910 | United Kingdom | 123/44 R |
| 516,201 | 12/1939 | United Kingdom | 123/44 R |

*Primary Examiner*—C. J. Husar

*Attorney, Agent, or Firm*—Criddle, Thorpe & Western

[57] ABSTRACT

An intake/exhaust system adapted for use in rotary engines having a rotatable cylinder block with a plurality of cylinders radially arranged in the block. A plurality of passages are defined in the cylinder block to extend between the cylinders and a plurality of cylinder ports for enabling communication with the cylinders. The cylinder ports are arranged to travel in a circular path as the cylinder block is rotated. Also included are a plurality of poppet valves, each positioned in a different one of the passages to allow or inhibit communication between each of the cylinder ports and the corresponding cylinder. Manifold apparatus includes an intake port and an exhaust port spaced apart and positioned adjacent to the path traversed by the cylinder ports such that the intake port and exhaust port are each aligned with successive ones of the cylinder ports as the cylinder unit is rotated. Fuel charges are supplied via the intake port to the cylinders when the corresponding cylinder port is aligned with the intake port and the corresponding valve is open to allow the fuel charge to pass into the corresponding cylinder. Exhaust gases flow from each cylinder through the exhaust port of the manifold apparatus when the corresponding cylinder port is aligned with the exhaust port and the corresponding valve is opened.

8 Claims, 4 Drawing Figures

ROTARY ENGINE INTAKE AND EXHAUST SYSTEM

BACKGROUND OF THE INVENTION

This invention relates to an intake and exhaust system for use in rotary engines.

There is a continuing interest in finding practical alternatives to the standard reciprocating internal combustion engines and much of this interest has been centered on rotary engine research and development. Various types of rotary engines have been proposed including engines which depart from the conventional cylinder/piston arrangement, such as the well known Wankel engine, and engines which utilize a cylinder/piston arrangement in an unconventional way, such as the engine disclosed in A. Z. Richards, Jr., U.S. Pat. No. 2,683,422. The Richards-type engine includes a cylinder block having a plurality of cylinders arranged generally radially about an axis about which the block rotates. Pistons are disposed to move within the cylinders and to rotate about a second axis offset from the first mentioned axis.

One of the difficulties of producing a practical Richards-type engine is the problem of introducing fuel and air into the cylinders of the cylinder block and withdrawing exhaust gases therefrom as the cylinder block rotates. The typical cam and valve structure used in standard reciprocating engines is simply not suitable for use in the Richards-type engine because of the rotating cylinder block. Suggestions have been made for eliminating valves altogether and for providing instead some type of structure in which fuel and air is supplied to the cylinders through openings in the cylinder walls and exhaust gases are withdrawn from the cylinders through the same or other openings in the cylinder walls. See, for example, U.S. Pat. No. 1,623,296 and 3,730,148. In the latter patent, openings in the cylinder walls of a rotating cylinder block alternatively move into alignment first with stationary inlet openings and then with stationary outlet openings to respectively receive fuel charges and then discharge products of combustion. Although fuel charges and exhaust gases may respectively be adequately supplied to and withdrawn from the cylinders, it is difficult to obtain a low friction seal structure which will adequately seal the cylinder openings to prevent loss of power during combustion in the cylinders.

SUMMARY OF THE INVENTION

It is an object of the present invention to provide, in rotary engines having a rotatable cylinder unit an intake and exhaust structure which seals high pressures developed by combustion while minimizing friction between rotating and stationary parts of the engine.

It is also an object of the present invention to provide such an intake and exhaust structure which is simple in construction and reliable in operation.

It is another object of the present invention to provide such a structure in which both fuel charges and exhaust gases are supplied to and withdrawn from the engine cylinders through a single cylinder port in each cylinder.

It is a further object of the invention, in accordance with one aspect thereof, to provide such a structure in which the flow of fuel charges and exhaust gases through each cylinder port is controlled by a single poppet valve in each cylinder.

The above and other objects of the present invention are realized in an illustrative embodiment of an intake and exhaust system adapted for use in a rotary engine which includes a cylinder unit rotatable about an axis and having a plurality of cylinders which extend generally outwardly from the axis. A plurality of passages and cylinder ports are defined in the cylinder unit, each passage leading to a different one of the cylinders and each terminating in a different one of the cylinder ports. When the cylinder unit is rotated, the cylinder ports rotate through an annular pathway. A plurality of valves, each operable to open or close a different one of the passages, are disposed in and carried by the cylinder unit. Manifold apparatus, having an intake port and an exhaust port, is disposed adjacent the pathway traversed by the cylinder ports so that the intake and exhaust ports momentarily and successively align with the cylinder ports as the cylinder unit is rotated. Fuel charges are supplied via the intake port to each cylinder when the corresponding cylinder port aligns with the intake port and when the corresponding valve is operated to open the corresponding passage. Exhaust gases are received via the exhaust port from each cylinder following ignition in the cylinder when the corresponding cylinder port aligns with the exhaust port and when the corresponding valve is operated to open the corresponding passage.

In accordance with one aspect of the invention, the intake apparatus also includes a buffer port positioned adjacent the pathway traversed by the cylinder ports so that as the cylinder unit is rotated the cylinder ports successively align with the intake port, buffer port and then exhaust port. Air is supplied via the buffer port to the cylinders when the corresponding cylinder ports are aligned with the buffer port. The function of this is to clear the cylinder passages of fuel charges prior to valve closure so that no combustion will occur in the cylinder passages, and so that no raw fuel will be discharged in the exhaust.

BRIEF DESCRIPTION OF THE DRAWINGS

The objects, features and advantages of the present invention will become apparent from a consideration of the following detailed description presented in connection with the accompanying drawings in which.

DETAILED DESCRIPTION

Figure 1:
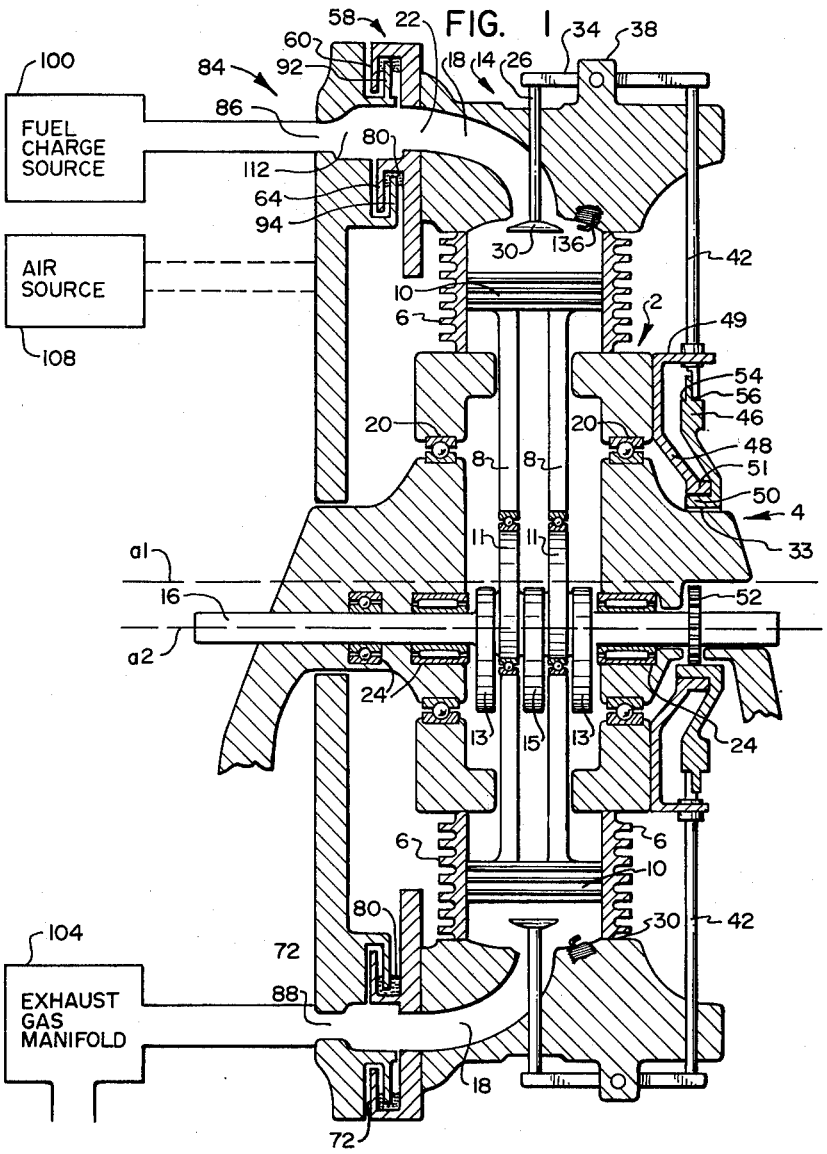
FIG. 1 is a side cross-sectional view of an intake and exhaust system made in accordance with the principles of the present invention.

Referring to FIG. 1, there is shown a side cross-sectional view of one illustrative embodiment of a rotary engine and the intake and exhaust sytem of the present invention. The intake and exhaust system of the present invention may be adapted for use with any rotary engine having a rotatable cylinder block such as the type described in the aforecited A. Z. Richards, Jr., patent. The rotary engine of FIG. 1 is similar to that described in the Richards patent.

The engine of FIG. 1 includes a cylinder unit or block 2 mounted on support structure 4 to rotate about an axis $a_1$. The block 2 includes six cylinders 6 radially and uniformally arranged about the axis $a_1$ (only two cylinders are shown in FIG. 1). Each cylinder 6 is paired with a diametrically opposite cylinder as described in copending application, Ser. No. 593,003. Pistons 10 are disposed to move within each cylinder 6, each piston being paired with and coupled to a piston of a diametrically opposite cylinder. Each such pair of pistons 10 is coupled by rods 8 to a corresponding eccentric 11 which is integral with or mounted on a rotatable shaft 16 whose axis $a_2$ is offset from the axis $a_1$ about which the cylinder block 2 rotates. The rod 8 and eccentric 11 of FIG. 1 are split, as is eccentric 13 to which another pair of pistons and rods (not shown) is coupled. A remaining pair of pistons and rods (also not shown) is coupled to eccentric 15. The centers of each of the eccentrics 11, 13 and 15 are spaced about the shaft 16 and apart from the centers of the other eccentrics by 120°. The centers of the eccentrics, of course, correspond to the centers of the respective piston pairs and are offset from the axis $a_1$. This general arrangement is fully described in the Richards patent.

The cylinder block 2 is mounted by bearings 20 to rotate on the support structure 4. The shaft 16 is mounted by bearings 24 to rotate within the structure 4. The shaft 16 extends through openings in either side of the structure 4 to enable coupling the shaft to a drive pulley or drive gear, to an ignition distributor, etc. (It might be noted that this provision for deriving power from the engine is different from that disclosed in the Richards patent, the latter involving a pulley mounted on the cylinder block.) As the cylinder block 2 is caused to rotate by combustion of fuel charges in the cylinders 6, the pistons 10 and rods 8 coact with the eccentrics to cause the rotation of the eccentrics and thus of the shaft 16.

Formed integral with or mounted on each cylinder 6 is a cylinder head 14 which defines a passage 18 leading from the top of the cylinder to a cylinder port 22 located in a plane positioned to one side of the cylinder block 2. The cylinder heads 14, of course, rotate with the cylinder block 2 to cause the cylinder ports 22 to traverse a generally circular pathway.

A single poppet valve 26 is disposed in each cylinder head 14 so that the stem of the valve extends radially outwardly of a corresponding cylinder 6 through the top of the cylinder head. The valve 26 is moveable between a closed position in which the valve head 30 seats over the cylinder opening to the passage 18 to close the passage, and an open position in which the valve head moves into the cylinder 6 to open the passage 18.

The top of each valve 26 is positioned to be contacted by one end of a rocker arm 34 pivotally mounted at 38 on the top of the cylinder head 14. The other end of the rocker arm 34 is contacted by a tappet 42 which is disposed to cam on a cam ring 46. The tappet 42 is held in place by a tappet holder 48 which is in the form of a ring mounted on the cylinder block 2 as shown. The tappet extends from the end of the rocker arm 34 through an opening in a flange 49 of the tappet holder 48 to the cam ring 46. The cam ring 46 is formed with an annular sleeve 50 projecting from the back of the cam ring to rotatably fit within a sleeve 51 formed in the tappet holder 48. The cam ring 46 is caused to rotate relative to the tappet holder 48 and thus relative to the cylinder block 2 by a gear wheel 52 which is mounted on the shaft 16. That is, an inner periphery 53 of the cam ring 46 includes a gear which coacts with and is driven by the gear wheel 52. As the cam ring 46 rotates relative to the cylinder block 2, and thus relative to the tappets 42, cam tracks 54 and 56 of the cam ring engage the tappets 42 to raise or lower the tappets, and thereby cause the corresponding valves to open or close. The operation of the cam ring 46, tappets 42, rocker arms 34 and valves 26 is described in detail in the aforecited copending patent application.

A sealing ring 58 is mounted on a side of each cylindrical head 14 so that openings in the ring coincide with the cylinder ports 22 in the cylinder heads 14. The cylinder ports 22 exposed and further defined by the sealing ring 58 are shown equally spaced in a circle in FIG. 2, each corresponding to a different one of said cylinders 6.

The sealing ring 58 is formed to define a pair of annular, trough-like vessels 60 and 64 open at their inner peripheries as generally indicated in FIG. 1. The function of the vessels 60 and 64 is to carry a sealing liquid 80, such as oil, which, in cooperation with an intake and exhaust manifold to be discussed momentarily, provides for sealing the rotating cylinder block parts with the stationary intake and exhaust manifold to allow the transfer of fuel charges and exhaust gases therebetween.

Figure 2:
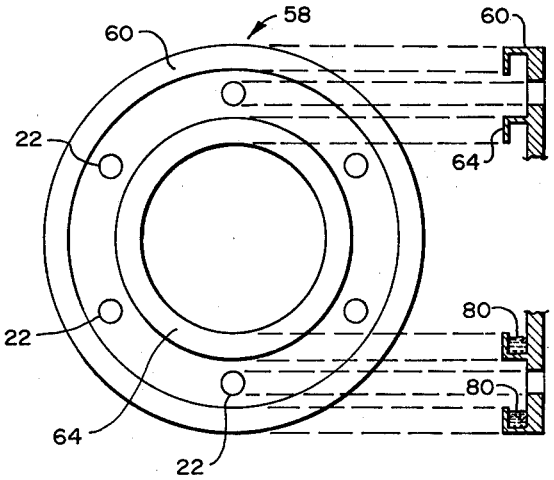
FIG. 2 is a front elevational view of the structure defining the cylinder ports of the system of FIG. 1 and also a side cross-sectional view of that structure.

As shown in FIG. 2, the cylinder ports 22 are positioned between the two annular vessels 60 and 64. The relationship of the front view of the sealing ring 58 shown in FIG. 2 to the side cross-sectional view, also shown in FIG. 2, is indicated by the dashed lines.

An intake and exhaust manifold 84 is positioned adjacent the cylinder block 2, contiguous with the sealing ring 58. The manifold 84 includes a pair of concentric annular flanges 92 and 94 which extend first laterally of the manifold and then outwardly and into the vessels 60 and 64 respectively as generally indicated in FIG. 1. The outer margins of the flanges 92 and 94 extend to a locus adjacent the outermost wall 72 of the respective vessels.

Figure 3:
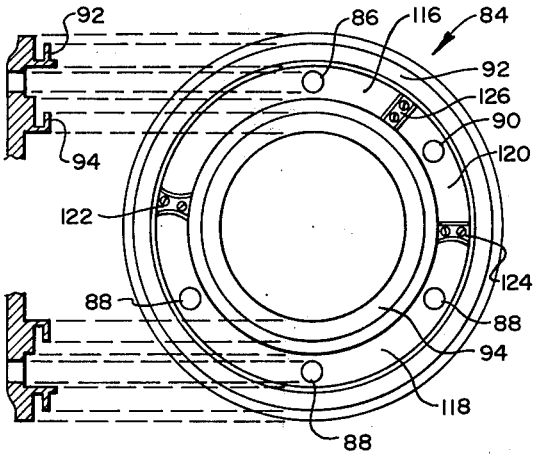
FIG. 3 is a front elevational view of the intake and exhaust manifold of the system of FIG. 1 and also a side cross-sectional view of that manifold.

The manifold 84 also defines an intake port 86, exhaust ports 88, and a buffer port 90 all positioned between the annular flanges 92 and 94 as shown in FIG. 3. The relation of the parts of the manifold 84 shown in the front view thereof in FIG. 3 to the side cross-sectional view of the manifold is indicated by dotted lines. The intake port 86 of the manifold 84 is coupled to a fuel charge source 100 (FIG. 1) which supplies fuel and air in a suitable proportion to the intake port for ultimate supply to the cylinders 6 of the cylinder block 2. The exhaust ports 88 are coupled to an exhaust gas manifold 104 which receives exhaust gases via the exhaust ports 88 from the engine cylinders 6. Finally, the buffer port 90 is coupled to an air source 108 which supplies air to the buffer port for ultimate supply to the engine cylinders 6 as will be described momentarily.

Figure 4:
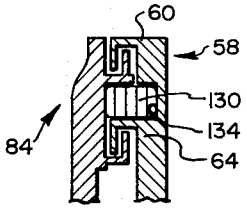
FIG. 4 is a side cross-sectional view of a portion of the manifold and cylinder port defining structure showing a partitioning element of the manifold.

An annular recess 112 is formed between the flanges 92 and 94 in the manifold 82 as generally indicated in FIG. 1. This recess is divided into three segments or portions 116, 118, and 120 (FIG. 3) by dividers or partitions 122, 124, and 126. As shown in FIG. 3, the intake port 86 is positioned in recess portion 116, the exhaust ports 88 are spaced in recess porton 118, and the buffer port 90 is positioned in recess portion 120. The dividers 122, 124, and 126 serve to isolate and prevent intermingling of fuel charges, exhaust gase and air either supplied to or received from the engine. The manner in which a typical divider 130 coacts with the sealing ring 58 is illustrated in FIG. 4. The divider 130 fills the annular recess 112 of the intake and exhaust manifold 84 at the locations shown in FIG. 3 and projects into the recess defined between vessels 60 and 64 of the sealing ring 58 to maintain sliding contact with a bottom wall 134 of the recess.

The operation of the intake and exhaust system of the present invention will now be described. When the cylinder block 2 is at rest (not rotating) the sealing liquid 80 contained in the vessels 60 and 64 of the sealing ring 58, is caused by gravity to flow downwardly in the respective vessels to fill the vessels as shown in FIG. 2. When the cylinder block 2 is caused to rotate, centrifugal force causes the liquid 80 to spread substantially uniformally in each vessel 60 and 64, as indicated in FIG. 1, so that the edges of the flanges 92 and 94 are immersed in the sealing liquid throughout the entire circumference of the flanges. In this manner, the manifold 84 is sealingly coupled to the sealing ring 58, which rotates with the cylinder block 2, with minimum friction being developed between the stationary and rotating parts. Thus, when the cylinder block 2 is rotated, the cylinder ports 22 successively align with the intake port 86, exhaust ports 88 and buffer port 90 to enable communication therebetween, with the seals created by the vessel 60 and 64, sealing liquid 80 and flanges 92 and 94 preventing communication to the atmosphere.

The cylinder block 2 is adapted to rotate in a direction to cause the cylinder ports 22 to move adjacent to recess portion 116, recess portion 120, and recess portion 118, in that order. To further explain the operation, reference will be had to the sequence of events which occur for a single cylinder. Assume that the cylinder port for a particular cylinder is just rotating from recess portion 18, past divider 122 and is commencing to traverse a path adjacent to recess portion 116 (FIG. 3). When this occurs, the piston disposed in the cylinder in question begins a downward stroke and the corresponding valve of the cylinder opens to allow a fuel charge, which has been supplied by the fuel charge source 100, to flow via intake port 86, recess portion 116 and corresponding passage 18 into the cylinder. While the cylinder port in question is traversing the pathway adjacent to the recess portion 116, the fuel charge is being drawn into the cylinder by the downward stroke of the piston. When the cylinder port moves past the divider 126 to the recess portion 120, the piston is still in its downward stoke to draw air from the air source 108 through the buffer port 90 into the passage 18. The purpose of this is to flush the remnants of the previously supplied fuel charge from the passage 18. If some of the fuel charge were allowed to remain in the passage 18 it might be inadvertently ignited, for example, by hot exhaust gases during the exhaust cycle, or raw fuel would be carried out with exhaust gases.

When the cylinder port in question passes the divider 124, the corresponding piston has reached the bottom of its stroke and the corresponding valve is closed. As the cylinder port continues past the recess portion 118, the piston moves upwardly to compress the fuel charge in preparation for combustion. When the port is at or near the divider 122, the fuel charge is ignited by a spark plug 136 to force the piston downwardly in a power stroke. The power stroke occurs while the cylinder port is passing adjacent the recess portion 116 and 120. When the cylinder port reaches the divider 124, the piston begins an upward exhaust stroke and the valve opens to allow exhaust gases to flow through the passage 18 and the cylinder port into the recess portion 118 and out the exhaust ports 88 into the exhaust gas manifold 104. When the cylinder port in question reaches divider 122, the intake, compression, power and exhaust strokes just described are repeated.

In the manner described, a simple and reliable intake and exhaust system is provided for rotary engines. The manifold 84, sealing ring 58, and poppet valves 26 cooperate to introduce fuel charges into the cylinders and remove exhaust gases therefrom. Only a single passage 18 need be provided to a cylinder because the cylinder port 22 is arranged to successively align with a fuel charge source, air source, and exhaust exit. Since only a single poppet valve is needed for each cylinder, larger valves may be used to improve volumetric efficiencies (improve "breathing") and to reduce pumping losses. Also, the single valve will operate at a relative cool temperature because intake air will tend to cool the valve (which is heated by exiting exhaust gases). Combining the use of a single valve for each cylinder with the arrangement of cylinder ports and intake port, exhaust port and buffer port enable the introduction of the necessary fuel charges and the exhausting port of the resulting combustion products through single cylinder passages without the sacrifice of power which might otherwise result either from faulty seals or from high frictional losses caused by the seals.

It is to be further understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. An intake/exhaust system or a rotary engine which includes a rotatable cylinder unit having a plurality of cylinders defined therein, said system comprising means defining a plurality of cylinder ports in said cylinder unit and a plurality of passages for enabling communication between each of said ports and a different one of said cylinders, said ports arranged to travel in a generally circular path as the cylinder unit is rotated, control means carried by the cylinder unit for allowing or inhibiting communication between the cylinder ports and corresponding cylinders, and means defining an intake port, an exhaust port, and a buffer port disposed between the intake port and the exhaust port, said ports being disposed adjacent the path traveled by said cylinder ports, said intake port being aligned with successive ones of said cylinder ports as the cylinder unit is rotated to supply fuel charges to the cylinder ports, said exhaust port being aligned with successive ones of said cylinder ports as the cylinder unit is rotated to receive exhaust products from the cylinder ports, and said buffer port being aligned with successive ones of said cylinder ports as the cylinder unit is rotated to supply air to said cylinder ports following intake of fuel charges.

2. An intake/exhaust system as in claim 1 wherein said cylinder ports are disposed generally in a plane perpendicular to the axis of rotation of the cylinder unit, and wherein said intake, exhaust and buffer ports are disposed generally in a plane parallel with and adjacent to the plane in which the cylinder ports are disposed.

3. An intake/exhaust system as in claim 2 wherein said cylinder port defining means comprises a first pair of concentric annular sealing members, said cylinder ports being disposed between the annular sealing members, and wherein said intake, exhaust and buffer port defining means comprises a second pair of concentric annular sealing members, each positioned to sealingly coact with a different one of said first pair of annular sealing members, said intake, exhaust and buffer ports being disposed between said second pair of annular sealing members.

4. An intake/exhaust system as in claim 1 wherein said control means comprises a plurality of poppet valve means, each movable between an open position wherein fluid is allowed to flow through a corresponding one of said cylinder ports and passages, and a closed position wherein fluid is inhibited from flowing through the corresponding cylinder port and passage.

5. An intake/exhaust system as in claim 4 wherein said control means further comprises cam means carried by said cylinder unit, and tappet means coupled to said plurality of poppet valve means for coacting with said cam means to selectively operate each of said valve means to the open position every other time the corresponding cylinder port is aligned with the intake port, and to the open position every other time the corresponding cylinder port is aligned with the exhaust port and following combustion in the corresponding cylinder.

6. In a rotary engine which includes a rotatable cylinder block having a plurality of cylinders extending generally outwardly from the axis of rotaton and means for igniting fuel charges introduced into the cylinders, an intake and exhaust system comprising a plurality of passages and cylinder ports defined in said cylinder block, said cylinder ports being annularly disposed in a plane generally perpendicular to the axis of rotation of said cylinder block, each of said passages leading to a different one of said cylinders and each terminating in a different one of said cylinder ports, said cylinder ports being rotatable in an annular pathway as said cylinder block is rotated, a plurality of poppet valves, each operable to open or close a different one of said passages to thereby respectively allow or prevent communication with the corresponding cylinder, and manifold means having an intake port and an exhaust port, both positioned to momentarily and successively align with said cylinder ports as said cylinder block is rotated, wherein fuel charges are supplied via said intake port to each cylinder when the corresponding cylinder port aligns with the intake port and when the corresponding valve is operated to open the corresponding passage, and wherein exhaust gasses are received via said exhaust port from each cylinder following ignition in the cylinder when the corresponding cylinder port aligns with the exhaust port and when the corresponding valve is operated to open the corresponding passage, said manifold means defining an annular trough positioned contiguous with and facing the pathway traversed by said cylinder ports, and including means for dividing the trough into first and second arcuate portions, said intake port disposed to communicate with and thereby convey fuel charges to said first portion, and said exhaust port disposed to communicate with and thereby receive exhaust gasses from said second portion.

7. An intake and exhaust system as in claim 6 wherein said manifold means has a buffer port positioned to momentarily and successively align with said cylinder ports as said cylinder block is rotated, wherein air is supplied via said buffer port to each cylinder when the corresponding cylinder port aligns with the buffer port and when the corresponding valve is operated to open the corresponding passage, wherein said manifold means further includes means for dividing said trough into first, second and third arcuate portions annularly positioned end to end so that as the cylinder block is rotated, the cylinder ports align with the first, third and second portions in succession, said buffer port being disposed to communicate with and supply air to said third portion.

8. An intake and exhaust system as in claim 7 wherein each of said poppet valves is disposed to extend generally radially outwardly of a different one of said cylinders, said system further including means carried by said cylinder block for alternately moving said valves radially inwardly to an open position to thereby allow fuel charges to enter the cylinders and exhaust gases to flow therefrom, and radially outwardly to a closed position to prevent the entry of fuel charges into the cylinders and the exit of exhaust gases therefrom, and a cam ring rotatable about the axis of rotation of said cylinder block for actuating said valve moving means.

* * * * *